US007515846B2

(12) United States Patent
Miyaji

(10) Patent No.: US 7,515,846 B2
(45) Date of Patent: Apr. 7, 2009

(54) CLEANING DEVICE, CHARGING DEVICE AND IMAGE FORMING APPARATUS

(75) Inventor: Shinki Miyaji, Osaka (JP)

(73) Assignee: Kyocera Mita Corporation (JP)

( * ) Notice: Subject to any disclaimer, the term of this patent is extended or adjusted under 35 U.S.C. 154(b) by 318 days.

(21) Appl. No.: 11/604,493

(22) Filed: Nov. 27, 2006

(65) Prior Publication Data

US 2007/0122180 A1 May 31, 2007

(30) Foreign Application Priority Data

Nov. 30, 2005 (JP) ..... 2005-347216

(51) Int. Cl.
*G03G 15/02* (2006.01)

(52) U.S. Cl. ..... 399/100; 399/176

(58) Field of Classification Search ..... 399/100, 399/99, 176

See application file for complete search history.

(56) References Cited

U.S. PATENT DOCUMENTS 6,088,551 A 7/2000 Satoh et al.

7,139,512 B2 * 11/2006 Namiki et al. ..... 399/176

FOREIGN PATENT DOCUMENTS

| | | |
|---|---|---|
| JP | 7-199604 | 8/1995 |
| JP | 8-22173 | 1/1996 |

* cited by examiner

*Primary Examiner*—Susan S Lee
(74) *Attorney, Agent, or Firm*—Gerald E. Hespos; Anthony J. Casella

(57) ABSTRACT

A cleaning device cleans a charging roller for charging the outer circumferential surface of a photoconductive drum while being rotated in contact with the photoconductive drum, and is provided with a cleaning brush for cleaning the outer circumferential surface of the charging roller by brushing while being rotated in contact with the outer circumferential surface of the charging roller, a rotational driving mechanism for rotating the cleaning brush while making the circumferential speed thereof differ from that of the charging roller, and a thrust driving mechanism for reciprocating the cleaning brush along a direction of a rotary axis of the charging roller while holding the cleaning brush in sliding contact with the outer circumferential surface of the charging roller.

14 Claims, 4 Drawing Sheets

CLEANING DEVICE, CHARGING DEVICE AND IMAGE FORMING APPARATUS

BACKGROUND OF THE INVENTION

1. Field of the Invention

The present invention relates to a cleaning device, a charging device and an image forming apparatus and particularly to a technology of cleaning a charging roller for charging the outer circumferential surface of a photoconductive drum.

2. Description of the Related Art

Nowadays, a charging roller for charging the outer circumferential surface of a photoconductive drum while being held in contact with the photoconductive drum is employed in an electrophotographic image forming apparatus to attain an ozone-less mechanism for charging the photoconductive drum. In this charging system using the charging roller, there is a possibility of causing charging unevenness by the attachment of toner external additive and the like to the outer circumferential surface of the charging roller particularly in the case of a solid-type charging roller having the roller surface thereof ground. To solve this problem, it is known to bring an elastic (spongy) cleaning member into contact with the outer circumferential surface of the charging roller to remove attachments from the roller surface, for example, as disclosed in Japanese Patent Publication No. 3515890. However, if the cleaning member is brought into contact with the roller surface, the toner external additive can be removed from the outer circumferential surface of the charging roller, whereas the toner external additive may be firmly fixed to the roller surface to harm a charging performance, thereby becoming a factor of causing charging unevenness. Accordingly, there have been proposed a charging roller cleaning device for reciprocating a cleaning member to improve a cleaning performance as disclosed in Japanese Unexamined Patent Publication No. H07-199604 and a technology of moving a cleaning member to and away from a charging roller as disclosed in Japanese Unexamined Patent Publication No. H08-22173.

The technologies disclosed in Japanese Unexamined Patent Publications Nos. H07-199604 and H08-22173 improve the cleaning performance of the cleaning device and the durability of the cleaning member in comparison with the charging device disclosed in Japanese Patent Publication No. 3515890, but there is a demand for further improvement in the cleaning performance and the durability.

SUMMARY OF THE INVENTION

In view of the problems residing in the prior art, an object of the present invention is to further improve the cleaning performance and durability of a cleaning device for a charging roller.

Specifically, the present invention is directed to a cleaning device for cleaning a charging roller for charging the outer circumferential surface of a photoconductive drum by being rotated in contact with the photoconductive drum, comprising: a cleaning member having a rotary shaft extending in a direction of a rotary axis of the charging roller, and rotating in contact with the outer circumferential surface of the charging roller and adapted to clean the outer circumferential surface of the charging roller by brushing; rotational driving unit rotating the cleaning member while making the circumferential speed thereof differ from that of the charging roller; and thrust driving unit reciprocating the cleaning member along the direction of the rotary axis of the charging roller while holding the cleaning member in sliding contact with the outer circumferential surface of the charging roller, the fineness of each bristle of a brush provided around the rotary shaft of the cleaning member being set to 10 T or lower and the bristle density of the brush being set to 300 kF/inch$^2$ or lower.

With this construction, the bristle fineness of the brush of the cleaning member is set to 10 T or lower and the bristle density is set to 300 kF/inch$^2$ or lower in order to prevent the adhesion of a toner external additive to the charging roller. Further, abrasion by the cleaning member and the charging roller is made uniform and the durability of the cleaning member is improved by rotating the cleaning member while making the circumferential speed thereof differ from that of the charging roller by unit of the rotational driving unit. Furthermore, the effect of removing the toner external additive from the charging roller is improved by reciprocating the cleaning member along the direction of the rotary axis of the charging roller while holding it in sliding contact with the outer circumferential surface of the charging roller by unit of the thrust driving unit.

Specifically, an effect of preventing the adhesion of the toner external additive to the charging roller is improved if the bristle fineness of the brush of the cleaning member is 10 T or lower and the bristle density is 300 kF/inch$^2$ or lower. On the other hand, since the bristles are thinner and the bristle density is lower, the effect of removing the toner external additive from the outer circumferential surface of the charging roller is weakened. Accordingly, the weakening of the above removing effect is compensated for by reciprocating the cleaning member along the direction of the rotary axis of the charging roller while holding it in sliding contact with the outer circumferential surface of the charging roller by unit of the thrust driving unit. Further, if the cleaning member is reciprocated along the direction of the rotary axis of the charging roller as described above, there is uncertainty about the durability of the cleaning member. Such uncertainty about the durability can be solved by rotating the cleaning member while making the circumferential surface thereof differ from that of the charging roller.

DETAILED DESCRIPTION OF THE PREFERRED EMBODIMENTS

Figure 1:
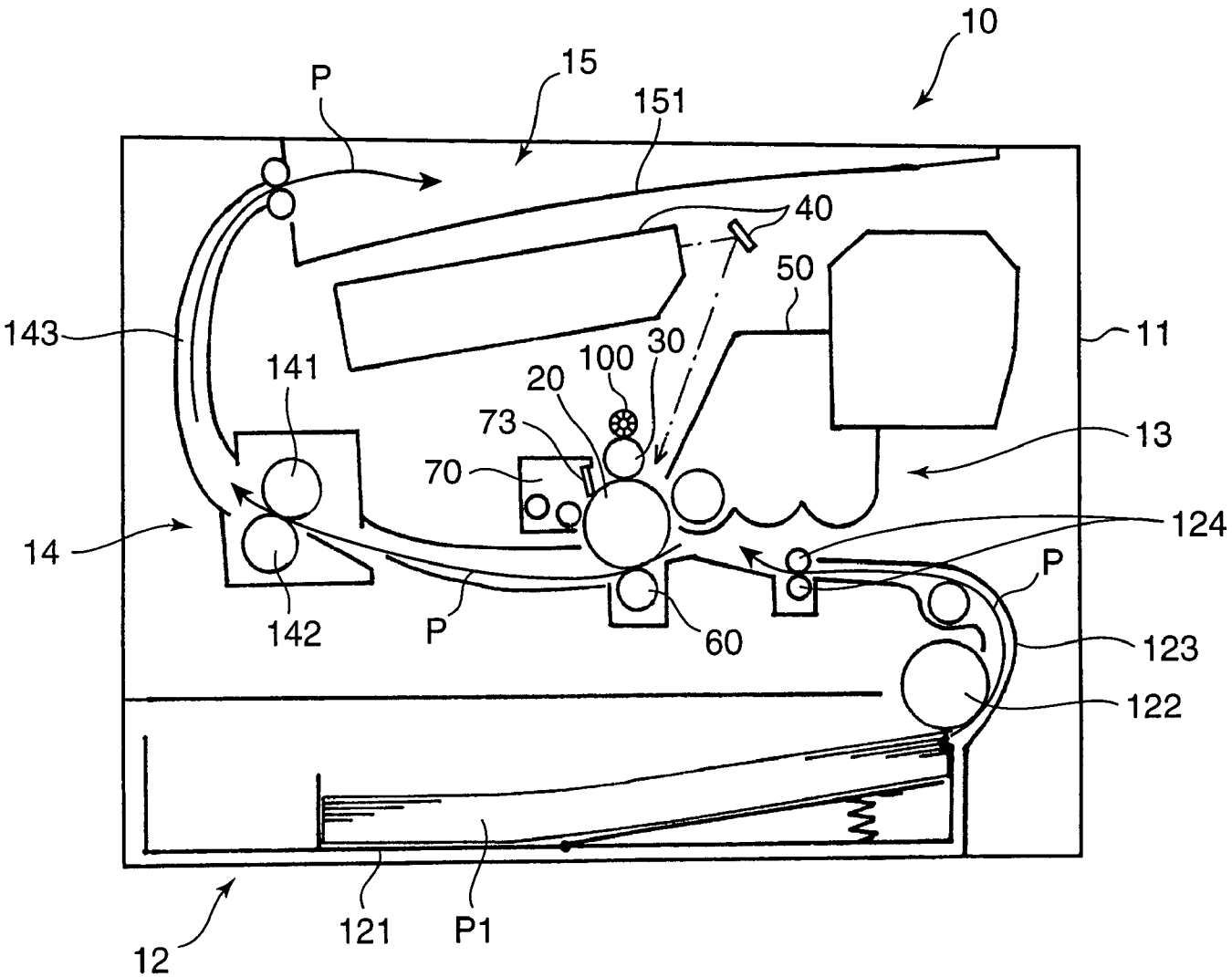
FIG. 1 is a diagram showing the schematic construction of a printer as one example of an image forming apparatus provided with a cleaning device according to the invention.

Hereinafter, a cleaning device and an image forming apparatus according to one embodiment of the present invention are described with reference to the accompanying drawings. FIG. 1 is a diagram showing the schematic construction of a printer as one example of the image forming apparatus provided with the cleaning device according to the invention. As shown in FIG. 1, in a printer (image forming apparatus) 10, a sheet storing section 12 for storing sheets P used for printing, a transferring section 13 for transferring images to the sheets (transfer target material) P dispensed one by one from a sheet stack P1 stored in the storing section 12, and a fixing section 14 for applying an image fixing operation to the sheet P having the image transferred thereto in the transferring section 13 are installed in an apparatus main body 11, and a discharging section 15 onto which the sheet P having the image fixed thereto in the fixing section 14 is discharged is provided atop the apparatus main body 11.

The sheet storing section 12 includes a specified number (one in this embodiment) of sheet cassette(s) 12 detachably mountable into the apparatus main body 11. A pickup roller 122 for dispensing the sheets P one by one from the sheet stack P1 is disposed at an upstream end (right side in FIG. 1) of the sheet cassette 121. The sheet P dispensed from the sheet cassette 121 by driving this pickup roller 122 is fed to the transferring section 13 via a feeding conveyance path 123 and a pair of registration rollers 124 disposed at a downstream end of the feeding conveyance path 123.

The transferring section 13 is for transferring an image to the sheet P based on image information electrically transmitted from a computer or the like, and includes a photoconductive drum (image bearing member) 20 rotatably disposed about its central axis extending in forward and backward directions (directions normal to the plane of FIG. 1), a charging roller 30, an exposing device 40, a developing device 50, a transfer roller 60 and a drum cleaning device 70, the parts 30, 40, 50, 60 and 70 being arranged around the outer circumferential surface of the photoconductive drum 20 in clockwise direction from a position right above the photoconductive drum 20.

The photoconductive drum 20 is for forming an electrostatic latent image and a toner image (visible image) S (see FIG. 2) in conformity with the electrostatic latent image on the outer circumferential surface thereof. An amorphous silicon layer is formed on the outer circumferential surface, thereby making it suitable to form these images.

The charging roller 30 is for uniformly charging the outer circumferential surface of the photoconductive drum 20 rotating in clockwise direction about the central axis thereof, i.e. for imparting electric charges to the photoconductive drum 20 by being driven to rotate by the photoconductive drum 20 while having the outer circumferential surface thereof held in contact with the outer circumferential surface of the photoconductive drum 20.

A cleaning brush (cleaning member) 100 rotates while being held in contact with the outer circumferential surface of the charging roller 30, thereby cleaning the outer circumferential surface of the charging roller 30 by brushing.

The exposing device 40 emits a laser beam modulated based on an image data electrically transmitted from an external apparatus such as a computer to the outer circumferential surface of the rotating photoconductive drum 20, whereby the electric charges are removed at parts of the outer circumferential surface of the photoconductive drum 20 irradiated with the laser beam to form an electrostatic latent image on the outer circumferential surface of the photoconductive drum 20.

The developing device 50 is for supplying toner (developing agent) T (see FIG. 2) to the outer circumferential surface of the photoconductive drum 20 to attach the toner T to the parts where the electrostatic latent image is formed, thereby forming the toner image S on the outer circumferential surface of the photoconductive drum 20.

The transfer roller 60 is for transferring the positively charged toner image S formed on the outer circumferential surface of the photoconductive drum 20 to the sheet P fed to a position right below the photoconductive drum 20 by imparting negative electric charges of the opposite polarity to the electric charges of the toner image S to the sheet P.

Accordingly, the positively charged toner image S on the outer circumferential surface of the photoconductive drum 20 is separated toward the front side of the negatively charged sheet P while the sheet P having reached the position right below the photoconductive drum 20 is nipped between the transfer roller 60 and the photoconductive drum 20, whereby an image transferring operation is applied to the sheet P.

The drum cleaning device 70 is for cleaning the outer circumferential surface of the photoconductive drum 20 after the image transferring operation by removing the residual toner T therefrom. The outer circumferential surface of the photoconductive drum 20 cleaned by this drum cleaning device 70 moves toward the charging roller 30 again for a next image forming operation.

The fixing section 14 is for fixing the toner image S to the sheet P having the toner image S transferred thereto in the transferring section 13 by heating, and is internally provided with a heat roller 141 having an electrical heating element mounted therein and a pressure roller 142 disposed below the heating roller 141 such that the outer circumferential surfaces of the rollers 141, 142 are opposed to each other. The sheet P after the image transferring operation passes a nip between the heating roller 141 drivingly rotated in clockwise direction about its central axis and the pressure roller 142 driven to rotate by the heating roller 141 in counterclockwise direction about its central axis to receive heat from the heating roller 141, whereby the image fixing operation is performed. The sheet P after the image fixing operation is discharged to the discharging section 15 through a discharging conveyance path 143.

The discharging section 15 is formed by recessing the top surface of the apparatus main body 11, and a discharge tray 151 for receiving the discharged sheet P is formed at the bottom of this recess.

Figure 2:
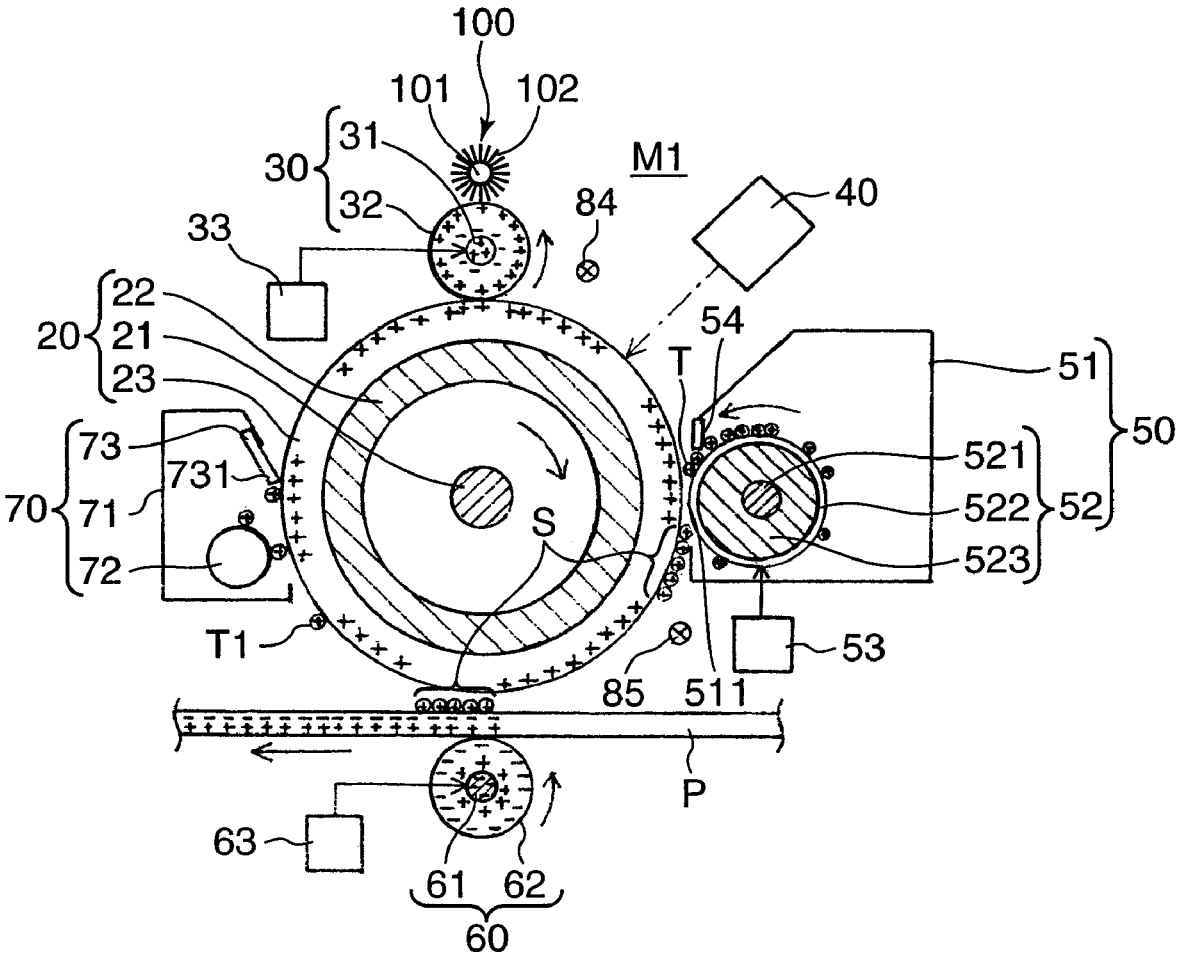
FIG. 2 is an enlarged diagram showing a photoconductive drum and its peripheral devices.

FIG. 2 is an enlarged diagram showing the photoconductive drum 20 and its peripheral devices. It should be noted that components of the photoconductive drum 20 and the thickness of the sheet P are shown in an exaggerated manner in FIG. 2. As shown in FIG. 2, the photoconductive drum 20 is comprised of a drum shaft 21, an aluminum prime tube 22 made of aluminum alloy and mounted rotatably and concentrically with the drum shaft 21, and an amorphous silicon layer 23 uniformly formed on the outer circumferential surface of the aluminum prime tube 22 by deposition or the like. Such a photoconductive drum 20 is rotated in clockwise direction by being driven by an unillustrated drum motor.

The charging roller 30 is for applying a voltage from a power supply 33 for charging roller to the amorphous silicon layer 23 with the outer circumferential surface thereof held in contact with that (i.e. amorphous silicon layer 23) of the photoconductive drum 20, and includes a charging roller shaft 31 made of metal and a charging roller main body 32 made of a dielectric material such as elastomer, integrally and concentrically fitted on the charging roller shaft 31. The charging roller main body 32 is of the solid type having the outer circumferential surface thereof ground.

As shown in FIG. 2, such a charging roller 30 is rotated in counterclockwise direction about its central axis by being driven by the clockwise rotation of the photoconductive drum 20 about the drum shaft 21 with positive charges distributed on the outer circumferential surface of the charging roller main body 32 through the application of the positive voltage from the power supply 33 for charging roller to the charging roller shaft 31, whereby positive electric charges are uniformly distributed on the amorphous silicon layer 23. The charging roller 30 is such that an elastic layer (thickness: 3 mm) made of an epichlorohydrin rubber is formed on a core bar of a diameter of 6 mm to have a roller diameter of 12 mm. The electric resistance of this elastic layer is $3\times10^6$ Ω·cm and the rubber hardness is 45 (JISA). Further, the surface roughness of the charging roller 30 is preferably 5 μm or higher and 20 μm or lower.

Figure 3:
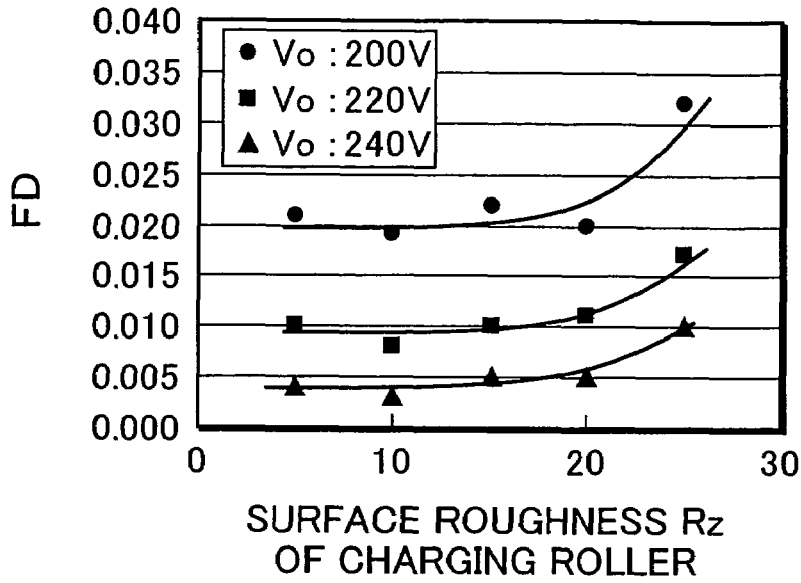
FIG. 3 is a graph showing a relationship between surface roughness (Rz) of the charging roller and fog density (FD).

FIG. 3 shows a relationship between surface roughness (Rz) of the charging roller 30 and fog density (FD). Since the fog density (FD) changes with surface potential Vo of the photoconductive drum 20, an experiment was conducted using three levels (200V, 220V, 240V) as the surface potential Vo of the photoconductive drum 20. It can be seen from FIG. 3 that the fog density (FD) is kept substantially at a constant level without increasing at any potential when the surface roughness (Rz) of the charging roller 30 is between 5 μm (inclusive) and 20 μm (inclusive).

The cleaning brush 100 extends in a direction of a rotary axis of the charging roller 30 and is for cleaning the outer circumferential surface of the charging roller 30 by brushing by being rotated in contact with the outer circumferential surface of the charging roller 30 while making the circumferential speed thereof differ from that of the charging roller 30. In this way, the cleaning brush 100 removes the toner external additive attached to the outer circumferential surface of the charging roller 30.

The cleaning bush 100 includes a brush shaft 101 and a bristle portion 102 and is driven to rotate about the brush shaft 101 and to reciprocate (thrusting movements) along the direction of the rotary axis of the charging roller 30 by driving mechanisms to be described later. The fineness of each bristle forming the bristle portion 102 is set to 10 T (decitex) or lower and the arrangement density of the respective bristles on the brush shaft 101 is set to 300 kF/inch$^2$ or lower. Further, the length of the respective bristles of the bristle portion 102 is set to 1.5 mm or longer. Furthermore, the cleaning brush 100 is set at the same potential as the charging roller 30 by the application of a voltage from an unillustrated power supply.

Figure 4:
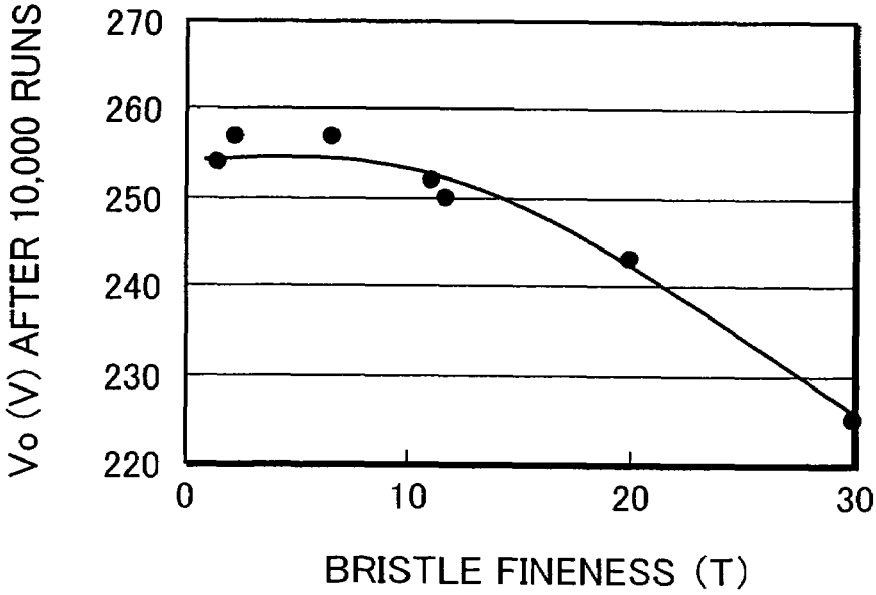
FIG. 4 is a graph showing a relationship between the fineness of each bristle (T) of the brush and surface potential Vo (V) of a photoconductive drum.

FIG. 4 shows a relationship between the fineness of the respective bristles of the bristle portion 102 and the surface potential Vo (V) of the photoconductive drum 20. The shown surface potentials are those of the photoconductive drum 20 after 10,000 runs with the surface potential of the photoconductive drum 20 initially set at about 255 V and the bristle portions having bristles of various finenesses and having a bristle density of about 300 kF/inch$^2$ held in contact with the charging roller 30. It can be seen from FIG. 4 that the surface potential of the photoconductive drum 20 is maintained substantially at the initial level even after 10,000 runs if the bristle portion having each bristle of a fineness of 10 T and having a bristle density of the bristles of about 300 kF/inch$^2$ is used.

Figure 5:
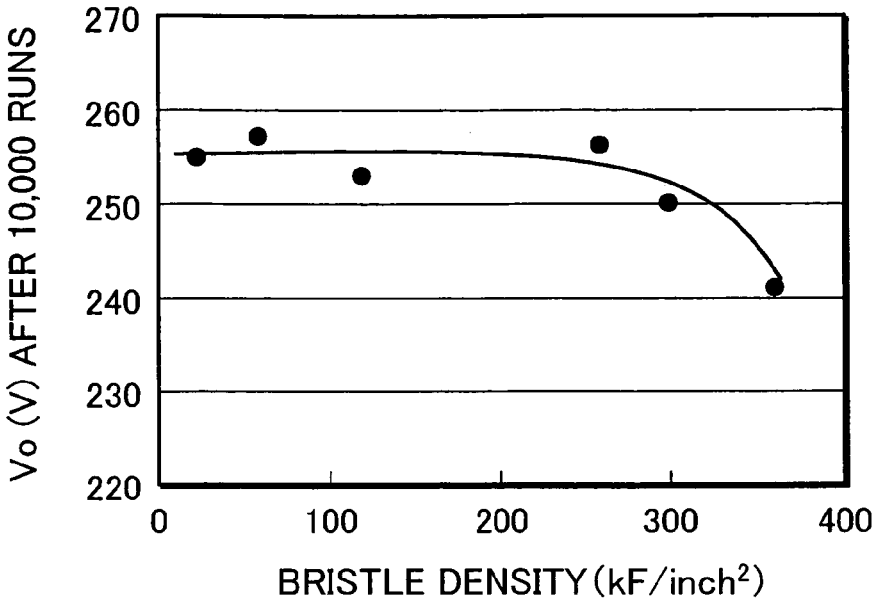
FIG. 5 is a graph showing a relationship between arrangement density (kF/inch$^2$) of the bristles of the bristle portion and the surface potential Vo (V) of the photoconductive drum.

FIG. 5 shows a relationship between the arrangement density (kF/inch$^2$) of the respective bristles of the bristle portion 102 and the surface potential Vo (V) of the photoconductive drum 20. The shown surface potentials are those of the photoconductive drum 20 after 10,000 runs with the surface potential of the photoconductive drum 20 initially set at about 255 V and the bristle portions having bristles of a fineness of 10 T and having various bristle densities (kF/inch$^2$) held in contact with the charging roller 30. It can be seen from FIG. 5 that the surface potential of the photoconductive drum 20 is maintained substantially at the initial level even after 10,000 runs if the bristle portion having each bristle of a fineness of 10 T and having a bristle density of about 300 kF/inch$^2$ is used.

The exposing device 40 emits a laser beam modulated based on electrically received image information to a uniform electric charge surface formed on the amorphous silicon layer 23 by the charging roller 30, whereby the positive electric charges on the outer circumferential surface (amorphous silicon layer 23) of the photoconductive drum 20 rotating about the drum shaft 21 disappear or reduced to an extremely low level to form an electrostatic latent image. In this embodiment, electric charges of several 100 V on the outer circumferential surface of the photoconductive drum 20 are reduced to about 10 V by the irradiation of the laser beam and the electrostatic latent image is formed on these parts of about 10 V. In FIG. 2, symbols "+" indicating the positive electric charges are deleted at the parts of the outer circumferential surface of the photoconductive drum 20 irradiated by the exposing device 40.

The developing device 50 is for forming the toner image in conformity with the electrostatic latent image formed by the exposing device 40 by supplying the toner T to the amorphous silicon layer 23 of the photoconductive drum 20. In a box-shaped developing device main body 51 filled with the toner inside, a developing roller 52 is mounted with the outer circumferential surface thereof partly exposed. The toner image S is formed on the outer circumferential surface of the amorphous silicon layer 23 by supplying the toner T (shown by symbols "+" in circles in FIG. 2) filled in the developing device main body 51 from the outer circumferential surface of the developing roller 52 rotating about its central axis parallel to the drum shaft 21 of the photoconductive drum 20 to the amorphous silicon layer 23 of the photoconductive drum 20 rotating about the drum shaft 21.

A wall surface of the developing device main body 51 facing the outer circumferential surface of the photoconductive drum 20 is formed with a toner supply opening 511 through which the toner T in the developing device main body 51 is transferred to the outer circumferential surface of the photoconductive drum 20, and the toner T in the developing device main body 51 is supplied to the outer circumferential surface of the photoconductive drum 20 through this toner supply opening 511 according to the rotation of the developing roller 52.

The developing roller 52 is comprised of a nonrotary developing roller shaft 521 arranged in parallel with the drum shaft 21, a fixed magnet 523 concentrically and integrally fitted on the developing roller shaft 521, and a development sleeve 522 fitted on the fixed magnetic 523 and drivingly rotated about the developing roller shaft 521. The development sleeve 522 is made of metal such as SUS or aluminum or electrically conductive resin.

Such a developing roller 52 is driven to rotate in counterclockwise direction about the developing roller shaft 521 by an unillustrated motor for developing roller with the outer circumferential surface of the development sleeve 522 positively charged through the application of a voltage (rectangular waves having a DC component of +170V, an AC amplitude of 1.7 kV, a frequency of 2.5 kHz, and a duty ratio of 45%) from a power supply 53 for developing roller, whereby the toner T in the developing device main body 51 is supplied to the amorphous silicon layer 23 of the photoconductive drum 20 while being positively charged.

A toner layer regulating blade 54 is provided at the upper edge of the toner supply opening 511 of the developing device main body 51. A toner layer regulating blade 54 is adapted for regulating the thickness of a layer of the toner T supplied from the outer circumferential surface of the development sleeve 522 to the photoconductive drum 20 to a uniform specified level as the developing roller 52 is rotated. The excessive supply of the toner T to the photoconductive drum 20 is prevented by letting the toner T pass under this toner layer regulating blade 54.

The transfer roller 60 is for separating the toner image S from the amorphous silicon layer 23 by imparting electric charges of opposite polarity (negative polarity in this embodiment) to that of the electric charges of the toner image S formed on the outer circumferential surface of the photoconductive drum 20 and transferring the separated toner image S to the sheet P being conveyed between the outer circumferential surface of the transfer roller 60 and the amorphous silicon layer 23.

Such a transfer roller 60 is comprised of a transfer roller shaft 61 in parallel with the drum shaft 21 of the photoconductive drum 21 and a transfer roller main body 62 concentrically and integrally rotatably fitted on the transfer roller shaft 61, and a negative voltage (transfer bias of −2.5 kV) from a power supply 63 for transfer roller is applied thereto. Accordingly, the toner image S made of the positively charged toner T is electrostatically attracted to the front side of the negatively charged sheet P by the sheet P being conveyed between the transfer roller main body 62 and the amorphous silicon layer 23 of the photoconductive drum 20 while being held in close contact with the outer circumferential surface of the transfer roller main body 62. In this way, the toner image S formed on the outer circumferential surface of the photoconductive drum 20 is transferred to the sheet P.

The drum cleaning device 70 is for removing residual toner T1 residual on the amorphous silicon layer 23 after the toner image S on the outer surface of the amorphous silicon layer 23 of the photoconductive drum 20 is transferred. Such a cleaning device 70 is comprised of a cleaning roller 72 mounted at a bottom part of a box-shaped cleaning device main body 71 and having the outer circumferential surface thereof held in contact with the outer circumferential surface (amorphous silicon layer 23) of the photoconductive drum 20, and a cleaning blade 73 mounted at an upper part of the cleaning device main body 71 such that the tip thereof is held in contact with the outer circumferential surface of the photoconductive drum 20.

The cleaning roller 72 is concentrically and integrally formed around a roller shaft 721 in parallel with the drum shaft 21. Such a cleaning roller 72 is made of a synthetic resin material being elastically deformable and having excellent tenacity.

Such a cleaning roller 72 is so rotated about the roller shaft 721 in a direction (counterclockwise direction in the example shown in FIG. 2) opposite to the rotating direction of the photoconductive drum 20 as to have a faster circumferential speed than that of the photoconductive drum 20, thereby abrading the outer circumferential surface of the amorphous silicon layer 23 to remove attachments such as corona discharge products for cleaning.

The cleaning blade 73 is a finishing cleaning member for the outer circumferential surface of the photoconductive drum 20 and is in the form of a plate made of an elastic material such as rubber. Such a cleaning blade 73 is so mounted at an upper position in the cleaning device main body 71 as to incline downward toward the tip thereof to face the amorphous silicon layer 23 of the photoconductive drum 20, and a blade edge 731 at the tip is held in contact with the amorphous silicon layer 23 while being slightly elastically deformed. Accordingly, the residual toner T1 that could not be removed by the cleaning roller 72 can be scraped off from the amorphous silicon layer 23 having reached the blade edge 731 via the cleaning roller 72 as the photoconductive drum 20 is rotated in clockwise direction.

The residual toner T1 on the amorphous silicon layer 23 scraped off by the cleaning roller 72 and the cleaning blade 73 is led into the cleaning device main body 71 and is collected into an unillustrated collection bottle provide in the apparatus main body 11 (see FIG. 1) by driving specified conveyance unit after being temporarily stored therein.

Figure 6:
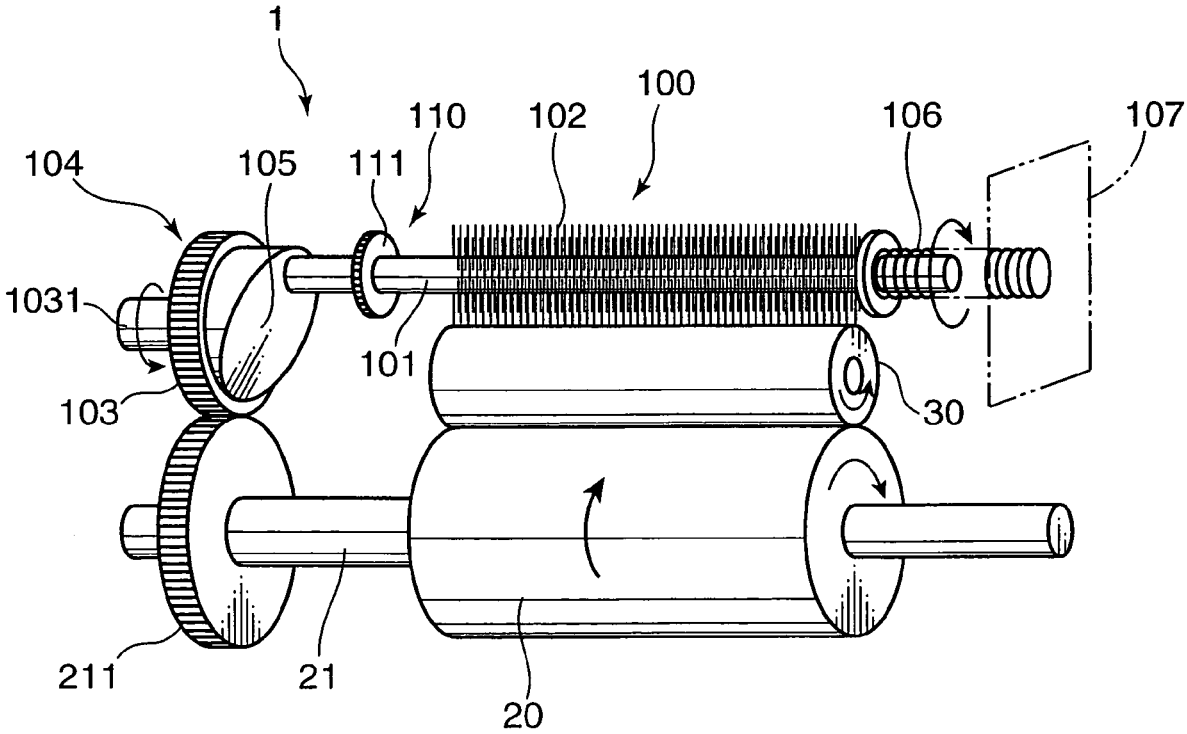
FIG. 6 is a perspective view showing a construction around the cleaning device provided with a cleaning brush.

FIG. 6 is a perspective view showing a cleaning device 1 provided with the cleaning brush 100 and its peripheral devices. The cleaning device 1 includes the cleaning brush 100, a thrust driving mechanism 104 and a rotational driving mechanism 110. The cleaning brush 100 is disposed at such a position as to touch the charging roller 30, but not to touch the photoconductive drum 20.

There is described the thrust driving mechanism (thrust driving unit) 104 for reciprocating (thrust movements) the cleaning brush 100 with a predetermined stroke along the direction of the rotary axis of the charging roller 30. A drive gear 211 is provided at an end of the drum shaft 21 of the photoconductive drum 20. The thrust driving mechanism 104 having a rotary drive gear 103 engageable with the drive gear 211 is provided at a position toward the cleaning brush 100 with respect to the drive gear 211. This rotary drive gear 103 has a cam 105 on its side surface toward the brush shaft 101 of the cleaning brush 100. The rotary drive gear 103 has a rotary shaft 1031 thereof supported by an unillustrated bearing.

On the other hand, a spring 106 is mounted at an end of the brush shaft 101 of the cleaning brush 100 opposite to the cam 105. This spring 106 is mounted on a side wall 107 of a casing enclosing the cleaning brush 100 and presses the brush shaft 101 (cleaning brush 100) toward the cam 105 to press the other end of the brush shaft 101 against the cam 105 by being located between the side wall 107 and the end of the brush shaft 101. It should be noted that the brush shaft 101 is so supported by an unillustrated bearing as to be capable of making thrust movements and rotation. The inclination of the cam 105 and a pressing force of the spring 106 are set such that the cleaning brush 100 reciprocates (makes thrust movements) with a stroke of 1 mm or longer along the direction of the rotary axis of the charging roller 30 during the rotation of the photoconductive drum 20. Further, a thrusting cycle is preferably one per one rotation of the cleaning brush 100.

The rotational driving mechanism (rotational driving unit) 110 of the cleaning brush 100 is, for example, constructed as follows. A driving-force transmitting gear 111 is mounted at a position of the brush shaft 101 of the cleaning brush 100 distanced from the bristle portion 102. This driving-force transmission gear 111 is engageable with a transmission gear coupled to a rotary shaft of an unillustrated driving source for rotating the brush shaft, and transmits a driving force from this driving source to the brush shaft 101. In this way, the outer circumferential surface of the cleaning brush 100 is rotated in the same direction as that of the circumferential surface of the charging roller 30. The driving force from the driving source and a gear ratio of the driving-force transmission gear 111 and the transmission gear are set such that the cleaning brush 100 is rotated while making the circumferential speed thereof differ from that of the photoconductive drum 20.

By such a rotational driving mechanism 110, the cleaning brush 100 is rotated about the brush shaft 101 by the driving force from the driving source transmitted to the driving-force transmission gear 111. When the photoconductive drum 20 is rotated, the thrust driving mechanism 104 is rotated by the engagement of the drive gear 211 and the rotary drive gear 103, and the brush shaft 101 pressed against the cam 105 by the spring 106 is pushed back according to the height of the brush shaft 101 on the surface of the cam 105. As a result, the cleaning brush 100 reciprocates in contact with the charging roller 30 along the direction of the rotary axis of the charging roller 30.

For example, the charging roller 30 having a surface roughness of 10 μm is used, the cleaning brush 100 whose bristle portion 102 has bristles made of nylon, having a fineness of 2.3 T (total fineness of 110 T/96 F) and a bristle density of 60 kF/inch$^2$ is used, and a biting amount of the bristle portion 102 into the charging roller 30 is set at 0.5 mm and the thrusting stroke of the cleaning brush 100 is set at 2 mm. The thrusting cycle is set to be one reciprocating movement per one rotation of the cleaning brush 100. Such settings are for Example 1. TABLE-1 shows an experiment result of a print durability test after 300,000 runs.

According to the setting in Embodiment 1, as can be seen from the durability test result, a fine image can be maintained until 300, 000 runs.

If an experiment is conducted with the settings of Example 1 minus the thrusting movements, photographic fog in the form of vertical lines occurs after 120,000 runs (Comparative Example 1).

Further, if an experiment is conducted with the bristle fineness of the bristle portion 102 changed to 20 T and the bristle density thereof changed to 360 kF/inch$^2$, photographic fog in the form of vertical lines occurs after 80,000 runs (Comparative Example 2).

TABLE 1

| | EXAMPLE 1 | C. EXAMPLE 1 | C. EXAMPLE 2 |
|---|---|---|---|
| DURABILITY TEST RESULT AFTER 300,000 | NO PROBLEM AFTER 300,000 RUNS | LINE FOGS AFTER 120,000 RUNS | FOG ON ENTIRE SURFACE AFTER 80,000 RUNS |

Such a cleaning device 1 has the following effects. An effect of preventing the adhesion of the toner external additive to the charging roller is improved if the bristle fineness of the bristle portion 102 is 10 T or lower and the bristle density is 300 kF/inch$^2$ or lower. On the other hand, since the bristles are thinner and the bristle density is lower, an effect of removing the toner external additive from the outer circumferential surface of the charging roller is weakened. However, by reciprocating the cleaning brush 100 along the direction of the rotary axis of the charging roller 30 while holding it in sliding contact with the outer circumferential surface of the charging roller 30, the effect of removing the toner external additive from the charging roller 30 is improved to compensate for the weakening of the effect of removing the toner external additive. Further, if the cleaning brush 100 is reciprocated along the direction of the rotary axis of the charging roller 30 as described above, there is uncertainty about the durability of the cleaning brush 100. Such uncertainty about the durability can be solved by rotating the cleaning brush 100 while making the circumferential surface thereof differ from that of the charging roller 30.

It should be appreciated that the present invention is not limited to the foregoing embodiment and various changes can be made. For example, the constructions shown in FIG. 6 are employed as the rotational driving mechanism 110 and the thrust driving mechanism 104 for the cleaning brush 100 in the foregoing embodiment. However, other constructions may be employed for the rotational driving mechanism and the thrust driving mechanism provided in the cleaning device 1 according to the present invention.

In short, a cleaning device for cleaning a charging roller for charging the outer circumferential surface of a photoconductive drum by being rotated in contact with the photoconductive drum, comprising: a cleaning member having a rotary shaft extending in a direction of a rotary axis of the charging roller, and rotating in contact with the outer circumferential surface of the charging roller and adapted to clean the outer circumferential surface of the charging roller by brushing; rotational driving unit rotating the cleaning member while making the circumferential speed thereof differ from that of the charging roller; and thrust driving unit reciprocating the cleaning member along the direction of the rotary axis of the charging roller while holding the cleaning member in sliding contact with the outer circumferential surface of the charging roller, the fineness of each bristle of a brush provided around the rotary shaft of the cleaning member being set to 10 T or lower and the bristle density of the brush being set to 300 kF/inch$^2$ or lower.

Further, a charging device, comprising: a charging roller for charging the outer circumferential surface of a photoconductive drum by being rotated in contact with the photoconductive drum; a cleaning member having a rotary shaft extending in a direction of a rotary axis of the charging roller, and rotating in contact with the outer circumferential surface of the charging roller and adapted to clean the outer circumferential surface of the charging roller by brushing; the fineness of each bristle of a brush provided around the rotary shaft of the cleaning member being set to 10 T or lower and the bristle density of the brush being set to 300 kF/inch$^2$ or lower; rotational driving unit rotating the cleaning member while making the circumferential speed thereof differ from that of the charging roller; and thrust driving unit reciprocating the cleaning member along the direction of the rotary axis of the charging roller while holding the cleaning member in sliding contact with the outer circumferential surface of the charging roller.

Furthermore, an image forming apparatus, comprising: a photoconductive drum having the outer circumferential surface on which an electrostatic latent image is to be formed; a charging roller for charging the outer circumferential surface of the photoconductive drum by being rotated in contact with the photoconductive drum; a cleaning member having a rotary shaft extending in a direction of a rotary axis of the charging roller, and rotating in contact with the outer circumferential surface of the charging roller and adapted to clean the outer circumferential surface of the charging roller by brushing; the fineness of each bristle of a brush provided around the rotary shaft of the cleaning member being set to 10 T or lower and the bristle density of the brush being set to 300 kF/inch$^2$ or lower; rotational driving unit rotating the cleaning member while making the circumferential speed thereof differ from that of the charging roller; and thrust driving unit reciprocating the cleaning member along the direction of the rotary axis of the charging roller while holding the cleaning member in sliding contact with the outer circumferential surface of the charging roller.

According to these devices and apparatus, the fineness of each bristle of the brush of the cleaning member is set to 10 T or lower and the bristle density of the brush is set to 300 kF/inch$^2$ or lower in order to prevent the adhesion of toner external additive to the charging roller. Further, abrasion by the cleaning member and the charging roller is made uniform and the durability of the cleaning member is improved by rotating the cleaning member while making the circumferential speed thereof differ from that of the charging roller by unit of the rotational driving unit. Furthermore, the effect of removing the toner external additive from the charging roller is improved by reciprocating the cleaning member along the direction of the rotary axis of the charging roller while holding it in sliding contact with the outer circumferential surface of the charging roller by unit of the thrust driving unit.

Specifically, an effect of preventing the adhesion of the toner external additive to the charging roller is improved if the bristle fineness of the brush of the cleaning member is 10 T or lower and the bristle density is 300 kF/inch$^2$ or lower. On the other hand, since the bristles are thinner and the bristle density is lower, the effect of removing the toner external additive from the outer circumferential surface of the charging roller is weakened. Accordingly, the weakening of the above removing effect is compensated for by reciprocating the cleaning member along the direction of the rotary axis of the charging roller while holding it in sliding contact with the outer circumferential surface of the charging roller by unit of the thrust driving unit. Further, if the cleaning member is reciprocated along the direction of the rotary axis of the charging roller as described above, there is uncertainty about the durability of the cleaning member. Such uncertainty about the durability can be solved by rotating the cleaning member while making the circumferential surface thereof differ from that of the charging roller.

In the present invention, the cleaning member is set at the same potential as the charging roller.

If an electric field acts on the toner external additive, a force acts to move the toner external additive either toward the cleaning member or toward the charging roller. Thus, there is a possibility of filming the brush of the cleaning member with the toner external additive or conversely promoting the adhesion of the toner external additive to the charging roller. With the above construction, an effect of uniformly distributing the toner external additive on the charging roller can be maximally brought out to prevent an electric field from acting on the toner external additive by setting the cleaning member at the same potential as the charging roller. As a result, the effect of preventing the adhesion of the toner external additive to the outer circumferential surface of the charging roller can be improved.

In the present invention, the length of the bristles of the brush of the cleaning member is set to 1.5 mm or longer.

If the length of the bristles of the brush of the cleaning member is less than 1.5 mm, the effect of removing the toner external additive from the charging roller is weakened, thereby causing the adhesion of the toner external additive in some cases. If the length of the bristles of the brush of the cleaning member is set to 1.5 mm or longer, both the effect of removing the toner external additive from the charging roller and the effect of preventing the adhesion of the toner external additive to the outer circumferential surface of the charging roller can be improved.

In the present invention, the reciprocating stroke of the cleaning member by the thrust driving unit is set to 1 mm or longer.

If the reciprocating stroke of the cleaning member is less than 1 mm, the tips of the bristles may not follow the reciprocating movements of the rotary shaft of the cleaning member if the brush of the cleaning member is specified such that the bristle fineness of the brush of the cleaning member is 10 T or lower and the bristle density is 300 kF/inch$^2$. However, if the reciprocating stroke of the cleaning member is set to 1 mm or longer, the effect of removing the toner external additive from the charging roller can be improved.

In the present invention, the surface roughness Rz of the charging roller is set to 5 μm or higher and 20 μm or lower.

By setting the surface roughness Rz of the charging roller as above, a possibility of causing charging unevenness can be reduced.

This application is based on patent application No. 2005-347216 filed on Nov. 30, 2005 in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A cleaning device for cleaning a charging roller for charging the outer circumferential surface of a photoconductive drum by being rotated in contact with the photoconductive drum, comprising:

a cleaning member having a rotary shaft extending in a direction of a rotary axis of the charging roller, and rotating in contact with the outer circumferential surface of the charging roller and adapted to clean the outer circumferential surface of the charging roller by brushing;

rotational driving unit rotating the cleaning member while making the circumferential speed thereof differ from that of the charging roller; and thrust driving unit reciprocating the cleaning member along the direction of the rotary axis of the charging roller while holding the cleaning member in sliding contact with the outer circumferential surface of the charging roller, the fineness of each bristle of a brush provided around the rotary shaft of the cleaning member being set to 10 T or lower and the bristle density of the brush being set to 300 kF/inch$^2$ or lower.

2. A cleaning device according to claim 1, wherein the cleaning member is set at the same potential as the charging roller.

3. A cleaning device according to claim 1, wherein the length of bristles of a brush of the cleaning member is set to 1.5 mm or longer.

4. A cleaning device according to claim 3, wherein the reciprocating stroke of the cleaning member by the thrust driving unit is set to 1 mm or longer.

5. A charging device, comprising:

a charging roller for charging the outer circumferential surface of a photoconductive drum by being rotated in contact with the photoconductive drum;

a cleaning member having a rotary shaft extending in a direction of a rotary axis of the charging roller, and rotating in contact with the outer circumferential surface of the charging roller and adapted to clean the outer circumferential surface of the charging roller by brushing; the fineness of each bristle of a brush provided around the rotary shaft of the cleaning member being set to 10 T or lower and the bristle density of the brush being set to 300 kF/inch$^2$ or lower;

rotational driving unit rotating the cleaning member while making the circumferential speed thereof differ from that of the charging roller; and thrust driving unit reciprocating the cleaning member along the direction of the rotary axis of the charging roller while holding the cleaning member in sliding contact with the outer circumferential surface of the charging roller.

6. A charging device according to claim 5, wherein the surface roughness of the charging roller is set to 5 μm or higher and 20 μm or lower.

7. A charging device according to claim 5, wherein the cleaning member is set at the same potential as the charging roller.

8. A charging device according to claim 5, wherein the length of bristles of a brush of the cleaning member is set to 1.5 mm or longer.

9. A charging device according to claim 8, wherein the reciprocating stroke of the cleaning member by the thrust driving unit is set to 1 mm or longer.

10. An image forming apparatus, comprising:

a photoconductive drum having the outer circumferential surface on which an electrostatic latent image is to be formed;

a charging roller for charging the outer circumferential surface of the photoconductive drum by being rotated in contact with the photoconductive drum;

a cleaning member having a rotary shaft extending in a direction of a rotary axis of the charging roller, and rotating in contact with the outer circumferential surface of the charging roller and adapted to clean the outer circumferential surface of the charging roller by brushing; the fineness of each bristle of a brush provided around the rotary shaft of the cleaning member being set to 10 T or lower and the bristle density of the brush being set to 300 kF/inch$^2$ or lower;

rotational driving unit rotating the cleaning member while making the circumferential speed thereof differ from that of the charging roller; and thrust driving unit reciprocating the cleaning member along the direction of the rotary axis of the charging roller while holding the cleaning member in sliding contact with the outer circumferential surface of the charging roller.

11. An image forming apparatus according to claim 10, wherein the surface roughness of the charging roller is set to 5 μm or higher and 20 μm or lower.

12. An image forming apparatus according to claim 10, wherein the cleaning member is set at the same potential as the charging roller.

13. An image forming apparatus according to claim 10, wherein the length of bristles of a brush of the cleaning member is set to 1.5 mm or longer.

14. An image forming apparatus according to claim 13, wherein the reciprocating stroke of the cleaning member by the thrust driving unit is set to 1 mm or longer.

* * * * *